United States Patent [19]

Calabrese

[11] Patent Number: 4,588,186

[45] Date of Patent: May 13, 1986

[54] STRETCHING APPARATUS

[76] Inventor: John Calabrese, 1125 W. 26 St., Erie, Pa. 16508

[21] Appl. No.: 624,470

[22] Filed: Jun. 25, 1984

Related U.S. Application Data

[63] Continuation-in-part of Ser. No. 497,274, May 31, 1983, Pat. No. 4,456,249.

[51] Int. Cl.[4] ..... A63B 21/00

[52] U.S. Cl. ..... 272/126

[58] Field of Search ..... 272/139, 93, 116, 126, 272/134, 136, 137, 143, 139, 94–96, 119–121, 80, 125, 142; 128/25 R

[56] References Cited

U.S. PATENT DOCUMENTS

| | | | |
|---|---|---|---|
| 1,402,179 | 1/1922 | Piscitelli | 272/139 |
| 1,618,273 | 2/1927 | Davidson | 272/139 |
| 2,097,376 | 10/1937 | Marshman | 272/139 |

FOREIGN PATENT DOCUMENTS

| | | | |
|---|---|---|---|
| 367748 | 1/1921 | Fed. Rep. of Germany | 272/80 |
| 18341 | of 1908 | United Kingdom | 272/142 |

*Primary Examiner*—Richard J. Apley
*Assistant Examiner*—William R. Browne
*Attorney, Agent, or Firm*—Ralph Hammar

[57] ABSTRACT

A self-contained stretching apparatus with two ropes extending from a shoulder harness fitting over the mid-chest region to a foot receiving stirrup. Each rope has a separate handgrip. By putting one foot in the stirrup and pulling the handgrips, various muscles and tendons may be stretched as part of a warming up exercise.

2 Claims, 8 Drawing Figures

STRETCHING APPARATUS

This is a continuation-in-part of application Ser. No. 497,274, filed 05/31/83 U.S. Pat. No. 4,456,249.

BACKGROUND OF THE INVENTION

Doctors have forbidden the use of the apparatus of U.S. Pat. No. 4,456,249 by persons with minor or chronic neck injuries, although substantial benefits can be realized. This invention eliminates the collar fitting over the head or neck and substitutes a shoulder harness having a loop surrounding the mid-chest supported by suspenders. The balance of the apparatus is retained in structure and in function. By using the apparatus of this application, patients with neck injuries can realize the benefits of controlled stretching of muscles and tendons without aggravating the neck injury.

DESCRIPTION OF THE PREFERRED EMBODIMENT

Figure 2A:
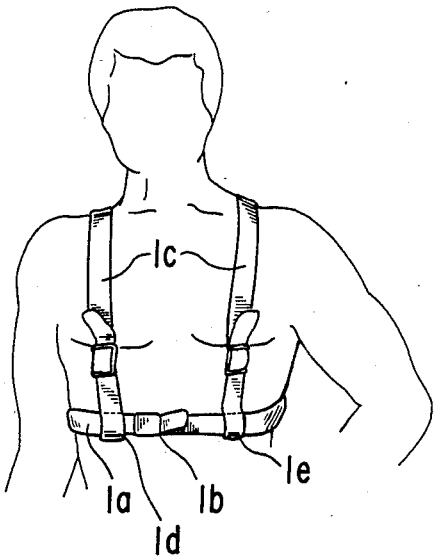
FIG. 2*a* is front view of a user.
Figure 1:
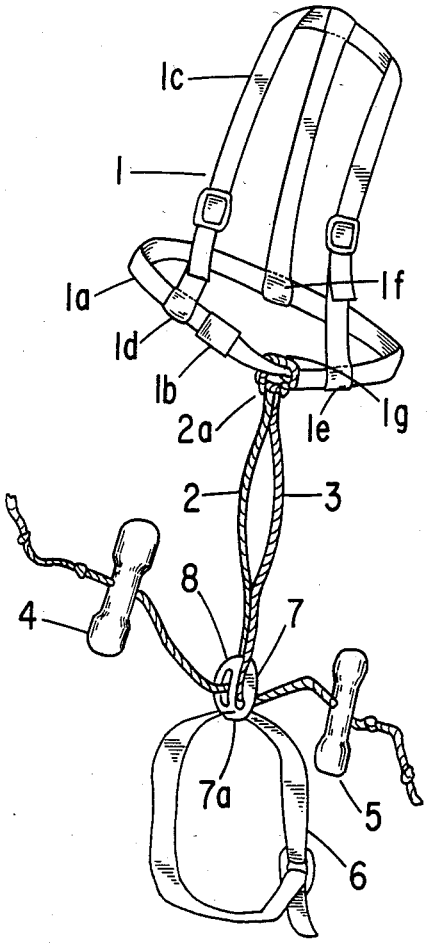
FIG. 1 is an elevation of the apparatus.
Figure 2B:
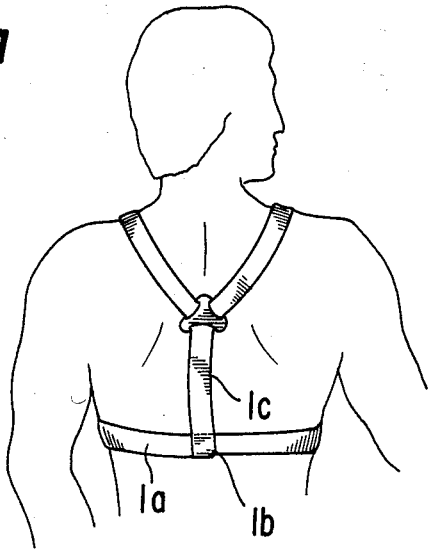
FIG. 2*b* is a back view of FIG. 2*a*.
Figure 3:
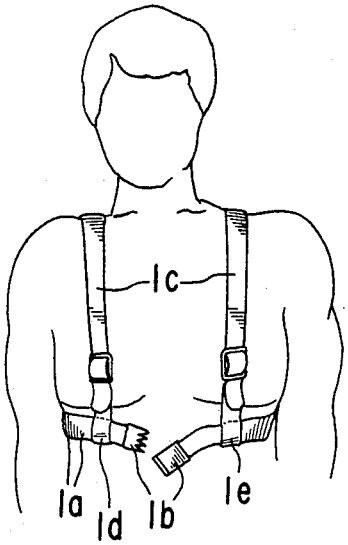
FIG. 3 shows the shoulder harness in process of mounting.

The apparatus consists of a shoulder harness 1, two ropes 2, 3, two handgrips 4, 5, and a single stirrup 6.

The shoulder harness 1 comprises an adjustable strap or belt 1*a* with ends adjustably connected by a quick release 1*b*. The belt extends around the mid-chest region, above the waist and under the arms. The belt is supported by suspenders 1*c* having ends 1*d*, 1*e*, 1*f* slidable on the belt 1*a*. The belt and suspenders constitute the shoulder harness which applies stretching forces to the shoulders and upper torso and prevents stressing the neck. The strap 1*a* and suspender may be polypropylene webbing.

The ropes 2, 3 are secured to the belt 1*a* by a ring 1*g* loosely received on the belt. Whenever the ropes are tensioned, the ring slides so the pull of the ropes on the strap is centered. In the particular construction shown, the ropes 2, 3 are opposite ends of a single length of rope, and a loop 2*a* is inserted through the ring 1*g* and the free ends of ropes 2, 3 are inserted through the projecting end of the loop. When the free ends are pulled tight through the loop, both ropes 2, 3 are fixed to the ring 1*g* and when the device is used, the tension in the ropes centers the ring 1*g* on the belt 1*a* so the tension of the ropes acts in a plane through the center of the belt. Polypropylene ropes are preferred.

The stirrup 6 may be an adjustable loop of flexible polypropylene strapping similar to the strap 1*a*. Normally the stirrup receives only one foot, but it will receive both feet easily with room to spare.

Tension from the ropes 2, 3 could be transferred to the stirrup by a ring similar to ring 1*g* used for the collar. This structure has the objection that friction between the ropes and the ring may cause overheating. A convenient commercially available antifriction structure is the pulley block 7 with two loose pulleys 8, one for each rope, and an eye 7*a* at the bottom slidably receiving the stirrup 6. The ropes 2, 3 each run over a separate pulley. A pull or tension force on the handgrips 4, 5 in any direction goes directly to the belt 1*a* through ropes 2, 3 and ring 1*g*. The handgrips may be adjustably positioned on the ropes. The tension force in the ropes 2, 3 also acts through pulleys 8 to lift pulley block 7 and thereby tension stirrup 6 which passes through the eye 7*a* on the lower end of the pulley block.

In the use of the device, it is expected that muscles and tendons will be stretched by movement beyond usual positions and that the user will become more limber. Athletes and ballet dancers use the stretching apparatus for a quicker and more thorough warm-up. Athletes who use the apparatus are less susceptible to injury.

The apparatus allows the athlete to stretch all major tendon groups in a manner which includes constant stretch in a mild and controlled manner and does not perform stretching with the bounce technique which should be avoided.

If athletes would use such a device daily in order to keep all muscle groups supple, the occurrence of strain-type injuries and overuse patterns would greatly and rapidly decrease.

The apparatus is self-contained—it can be used anywhere. No installation is required.

The apparatus is not intended for muscle development. Tensing or overstressing muscles is avoided.

Figure 4:
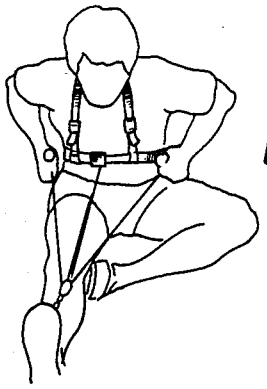
FIGS. 4–7 illustrate various exercises.
Figure 7:
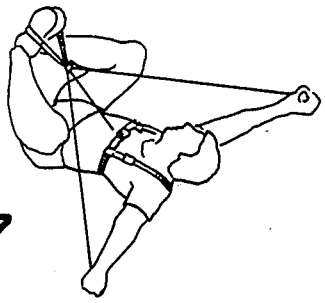
Figure 5:
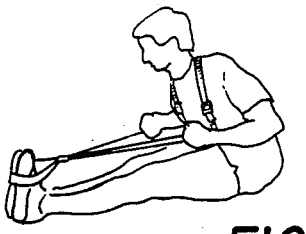
Figure 6:
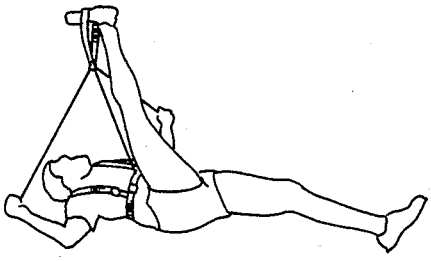

The apparatus is to be used under professional supervision. A few of the exercises are illustrated in FIGS. 4–7. Subject to professional limitations, the exercises will duplicate those permitted by U.S. Pat. No. 4,456,249 omitting stress on the neck.

I claim:

1. Self-contained stretching apparatus comprising shoulder harness having a first flexible strap loop fitting around the mid-chest region above the waist and under the arms, a first ring means connected directly to and slidably mounted on said first loop, two ropes, each rope having one end fixed to the first ring, a second flexible strap loop forming a foot receiving stirrup, a second ring means adjustably mounted on and forming a connection to said second loop, a right handgrip connected to the other end of one of said ropes, said one rope having its midsection running through said second ring means, a left handgrip connected to the other end of the other of said ropes, said other of said ropes having its midsection running through said second ring means whereby pulling on the handgrips regulates the tension in the ropes between said first and second loops.

2. Self-contained stretching apparatus comprising a first flexible strap loop fitting around the mid-chest region above the waist and under the arms, a first ring connected directly to and slidably mounted on said first loop, two ropes, each of said ropes having one end fixed to the first ring, a pulley block having two loose pulleys, a right handgrip connected to the other end of one rope, said one rope having its midsection running over one of said pulleys, a left handgrip connected to the other end of the other of said ropes, said other rope having its midsection running over the other of said pulleys, a foot receiving stirrup connected to the block, and said ropes forming a tension connection between the pulley block and the first loop whereby the tension in said ropes between said first loop and said stirrup is regulated by pulling forces on said handgrips.

* * * * *